US007674210B2

(12) United States Patent
Girardin

(10) Patent No.: US 7,674,210 B2
(45) Date of Patent: Mar. 9, 2010

(54) EXERCISE DEVICE

(76) Inventor: Gaston Girardin, 30 Birge Ave., Windsor Locks, CT (US) 06096

( * ) Notice: Subject to any disclaimer, the term of this patent is extended or adjusted under 35 U.S.C. 154(b) by 0 days.

(21) Appl. No.: 12/151,090

(22) Filed: May 1, 2008

(65) Prior Publication Data

US 2009/0275446 A1 Nov. 5, 2009

(51) Int. Cl.
*A63B 21/02* (2006.01)

(52) U.S. Cl. ..... 482/122; 135/64

(58) Field of Classification Search ..... 482/121–130, 482/148; 135/64–67; 280/87.021; 705/2; 297/5

See application file for complete search history.

(56) References Cited

U.S. PATENT DOCUMENTS

| | | | | |
|---|---|---|---|---|
| 2,706,632 A | | 4/1955 | Chandler | 272/80 |
| 3,918,710 A | | 11/1975 | Niebojewski | 272/81 |
| 4,621,625 A | | 11/1986 | Powlan | 128/84 C |
| 4,781,374 A | | 11/1988 | Lederman | 272/134 |
| 4,985,947 A | | 1/1991 | Ethridge | 5/81 R |
| 5,048,825 A | * | 9/1991 | Kelly | 482/94 |
| 5,509,894 A | | 4/1996 | Mason et al. | 601/34 |
| 5,924,966 A | * | 7/1999 | Havlovic | 482/129 |
| 5,961,512 A | | 10/1999 | Purnell | 606/1 |
| 6,390,957 B1 | | 5/2002 | Knight | 482/79 |
| 2006/0135329 A1 | | 6/2006 | Owen | 482/123 |

* cited by examiner

*Primary Examiner*—Lori Baker
(74) *Attorney, Agent, or Firm*—Alix, Yale & Ristas, LLP

(57) ABSTRACT

An exercise device, in particular an exercise device that can be attached to a conventional walker so that the user can operate it while supporting himself with the walker. The device features a base bar that can be attached to at least two legs of a walker and also attached to a second cross bar fit with support rollers, such as pulleys. A cable extends substantially the length of the cross bar, hangs down near the ends of the cross bar, and is disposed on the rollers. On one hanging end of the cable is attached a weight or similar resistance mechanism and on the other end is attached a stirrup or the like suitable for insertion of the user's limb. The height of the stirrup can be adjusted for various exercises and the user can exercise by moving his inserted limb against the resistance.

20 Claims, 4 Drawing Sheets

EXERCISE DEVICE

BACKGROUND

The present invention relates to accessories for so-called "walkers" used by persons who are frail or rehabilitating.

One of the biggest challenges faced by those who require the assistance of a walker is appropriately exercising limbs. Many require assistance from another and/or use of a gym or rehabilitation facility, which creates additional inconveniences and discourages exercise. The aim of the invention is to provide a portable device that allows users of walkers to exercise their limbs easily in any location and without excessive setup or assistance.

SUMMARY

The present invention builds on traditional resistance training by providing an easy-to-use portable device that is attachable directly to a user's conventional walker, therefore facilitating exercise and/or rehabilitation.

One representative embodiment is directed to an exercise device for facilitating limb movement comprising at least one cross bar; a cable support system on the cross bar including a cable having a first end and a second end; a resistance member attached to the first end of the cable; and a stirrup or the like at the second end of the cable, capable of receiving a limb to be exercised; and the cross bar or cable support system being rigidly attachable a walker frame.

BRIEF DESCRIPTION OF THE DRAWING

The invention will now be described with reference to the drawing where.

DESCRIPTION OF THE PREFERRED EMBODIMENTS

Figure 1:
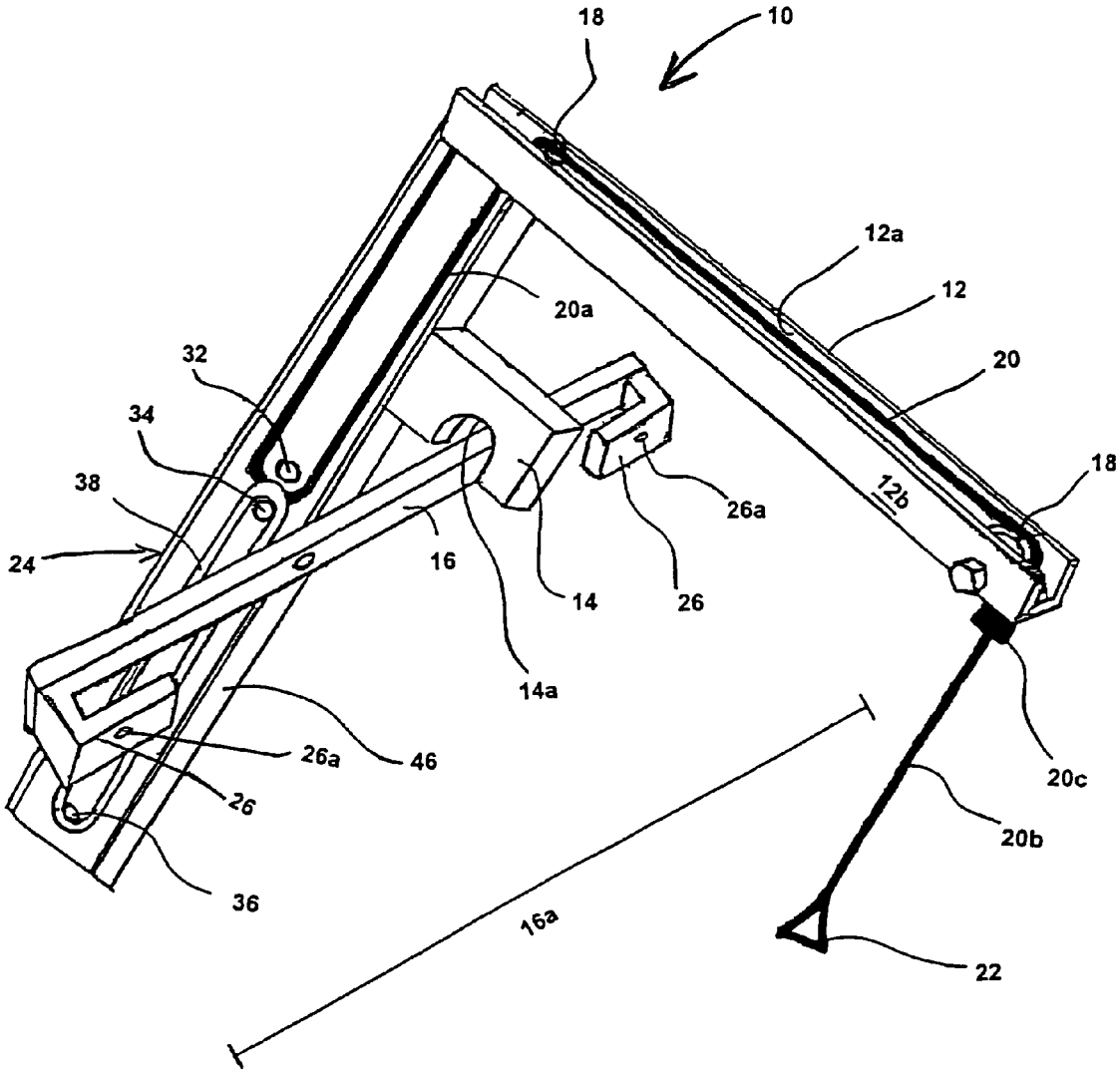
FIG. 1 is a schematic diagram of the exercise device according to another embodiment featuring an alternative method of resistance attached to a conventional walker as the device is normally used.
Figure 2:
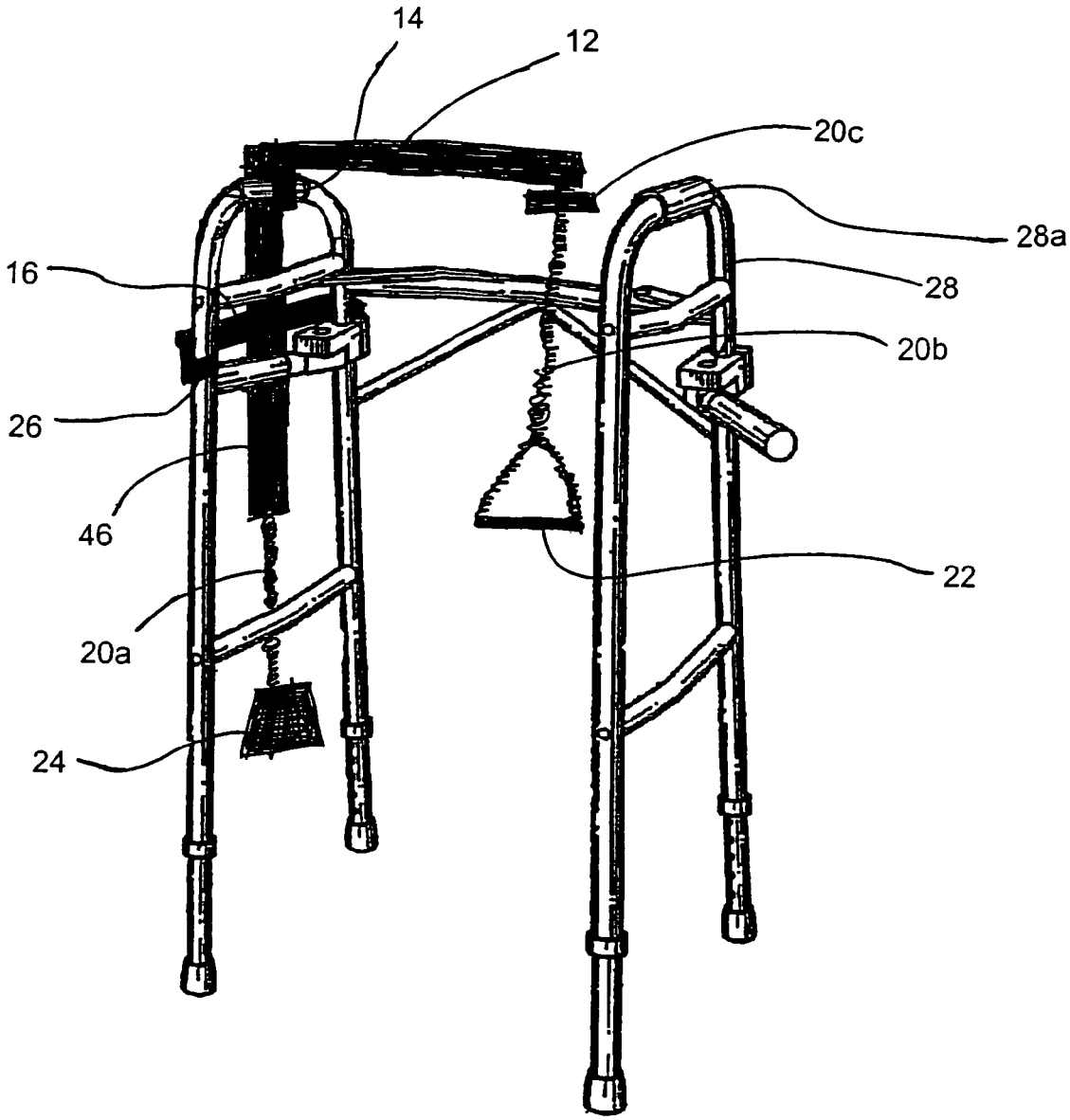
FIG. 2 is a schematic diagram of the exercise device of FIG. 1 attached to a conventional walker as it is normally used.

The exercise device 10 depicted in FIG. 1 is generally used in conjunction with a conventional walker or walking frame, such as that represented by reference number 28 in FIG. 2.

Figure 3:
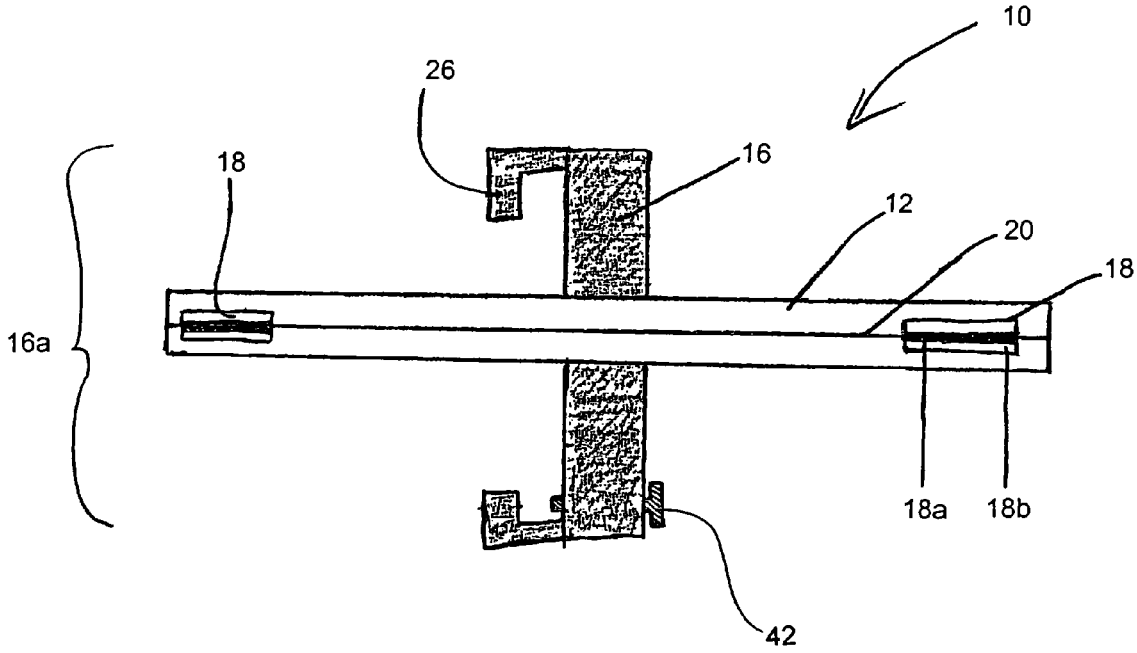
FIG. 3 is a plan view of the exercise device according to a preferred embodiment.
Figure 4:
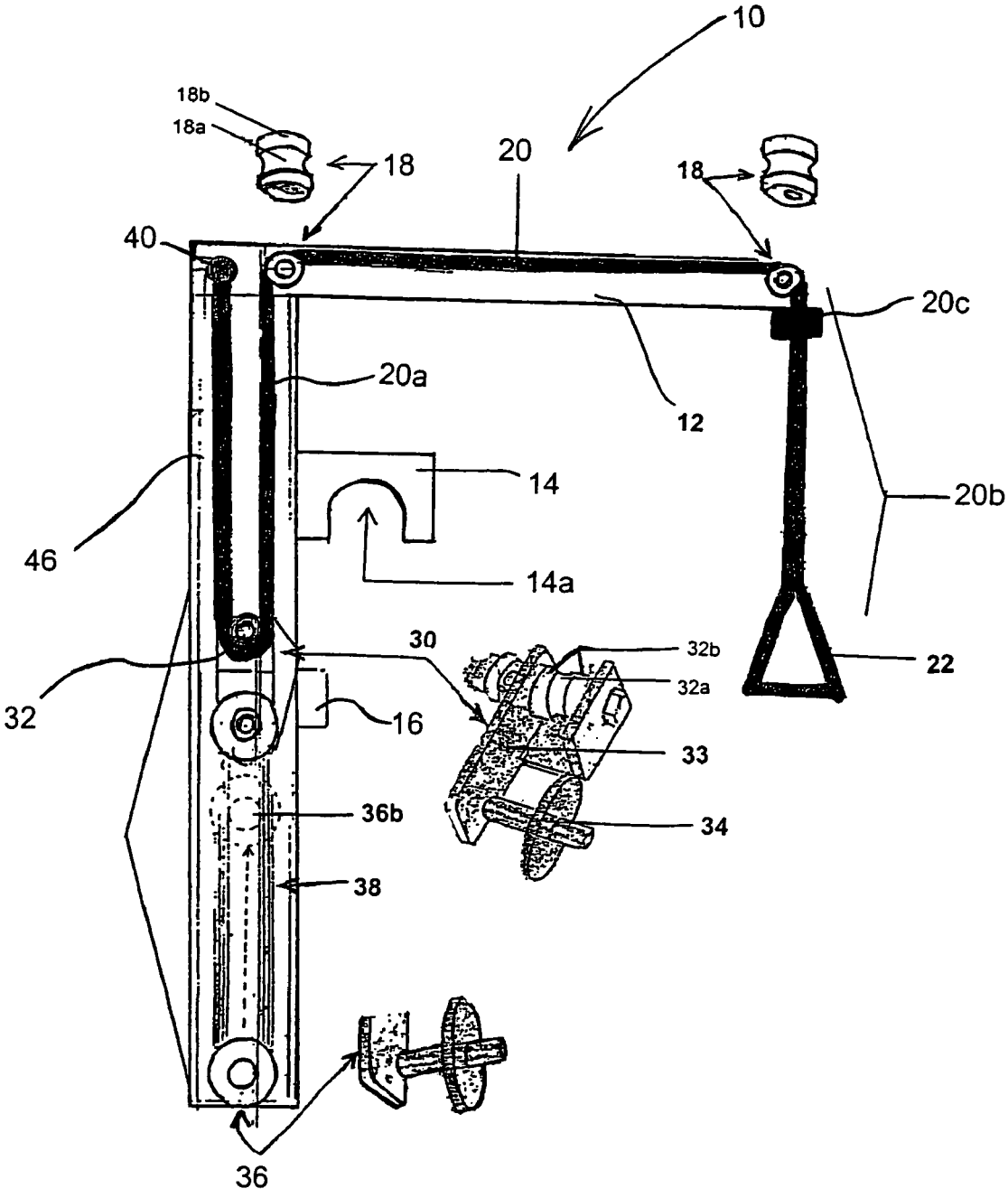
FIG. 4 is a schematic diagram of the exercise device showing enlarged views of several elements of the device.

In a preferred embodiment of the invention depicted in FIGS. 1, 3 and 4, the resistance is provided by elastic bands, whereas in the simpler embodiment depicted in FIG. 2 the resistance is provided by gravity on a weight. Both embodiments have analogous functional features. The exercise device 10 comprises U-section cross bar 12 with inner surface 12*a* and outer surface 12*b*, defining a longitudinal axis. Cross bar 12 is preferably positioned with U-shaped channel facing upward. Inside the U-shaped channel of cross bar 12 is located at least two guide members 18. Guide members 18 are disposed longitudinally spaced from each other, preferably at or near opposite ends of the inner channel of cross bar 12. In this embodiment, the guide members 18 are pulley rollers, each with groove 18*a* disposed between two flanges 18*b*, as depicted more closely from above in FIG. 3 and enlarged in FIG. 4. In this embodiment, cross bar 12 is generally straight, but it is possible to practice the invention with a curved cross bar. It should also be appreciated that cross bar 12 need not be confined to a U-shape. Employing a cross bar with an L, planar or tubular shape in the device is clearly feasible.

Exercise device 10 further comprises base bar 16. In the embodiment of FIGS. 1 and 3, 4, base bar 16 extends generally perpendicular and is rigidly attached to cross bar 12 via housing 46 (described in detail below), preferably at or near the longitudinal center of base bar 16. Base bar 16 comprises a generally linear body 16*a* and two connection wings 26, each disposed at or near opposite ends of body 16*a*. In this embodiment, connection wings 26 are generally L or U-shaped and each face inward toward the center of base bar 16. Base bar 16 can then be slidably engaged with and removably attached to two legs of walking frame 28 via external screws 26*a* in connection wings 26. Base bar 16 and connection wings 26 can be one continuous piece of rigid material, for example metal, rather than two separate units joined together. It should also be realized that base bar 16 and cross bar 12 need not be connected via housing 46. Any unit that can effect a rigid, generally perpendicular connection between these parts can be employed for this purpose. Alternatively, cross bar 12 can be rigidly attached directly to a base bar 16 without the use of any additional unit. In yet another embodiment cross bar 12 is selectively rotatable in relation to base bar 16.

A depiction of the simple embodiment of the device attached to a walking frame as it is normally used is shown in FIG. 2. While the embodiment described above features screws or bolts for attachment, any known connection means can be employed, including but not limited to a bracket assembly or clamp, as depicted as reference numeral 42 in FIG. 3. Further, it is envisioned that walking frames can be designed specifically for engagement with an exercise device according to the invention, and thus provide screw holes or an additional support means that improve connectivity and stability of the device.

In this embodiment, support member 14 is also rigidly attached to housing 46. Support member 14 features an arched projection 14*a* that substantially conforms to the arch or handle 28*a* of walking frame 28 when engaged. In other embodiments, support member 14 could be attachable to another part of the walking frame 28 and/or further attached to the walking frame 28 via an exterior screw or the like.

Exercise device 10 further comprises cable support system 20, having two ends, 20*a* and 20*b*. Cable support system 20 extends substantially the length of cross bar 12 and comprises a cable positioned inside grooves 18*a* between flanges 18*b* of guide members 18, with a significant length extending (i.e., hanging down) from at least one end of cross bar 12. In the embodiment of FIG. 2, resistance member 24 is a mass of heavy material disposed on end 20*a* of the cable 20, located to the outside of walking frame 28, and limb receiving unit 22 is carried on cable end 20*b*, located to the inside of walking frame 28. Cable support system 20 can be any rope-like structure that is capable of holding weight in tension and withstanding repeated use in the exercise device.

Resistance member 24 is preferably surrounded on three sides by housing 46, as depicted best in FIGS. 1 and 4. When engaged with the walking frame 28, housing 46 is positioned relatively upright and perpendicular to the ground. Cross bar 12, support member 14 and base bar 16 are rigidly attached to housing 46. Housing 46 can also feature a removable cover that can be placed over the open face of the housing 46 so that the resistance member 24 and cable support system 20 are hidden from view during use of the device.

As depicted most clearly in FIG. 4, the preferred resistance member 24 comprises a slidably attached upper resistance unit 30 and selectively slidably attached lower band catch 36. Upper resistance unit 30 comprises resistance guide member 32, upper resistance panel 33 and upper band catch 34. Upper band catch 34 is rigidly attached to upper resistance panel 33 and disposed vertically below resistance guide member 32. Resistance guide member 32 is structurally similar or identical to pulley-like guide members 18 with groove 32*a* and flanges 32*b* corresponding to grooves 18*a* and flanges 18*b*. In this embodiment, outside end 20*a* of cable support system 20 extends essentially vertically downward from guide member 18 toward the outside edge of cross bar 12, is positioned in groove 32*a* of resistance guide member 32 and then extends essentially vertically upward where it is held in place by bolt 40. A stretchable band 38 is positioned around upper band catch 34 and stretched around lower band catch 36 to provide resistance for the exercise device. While a bolt is described as holding the outside end of the support system in place, any component that can hold the outside end in a stationary position while the device is in use and can be employed.

While the embodiments discussed herein feature resistance member 24 carried on end 20*a* outside walking frame 28 and receiving unit 22 on end 20*b*, it is possible to practice the invention with resistance member 24 and receiving unit 22 in the inverse position.

An adjustable stopper 20*c* can be positioned on inside end 20*b* laterally disposed between receiving unit 22 and the edge of cross bar 12. The exact lateral position of stopper 20*c* on cable support system 20 is adjustable depending on the user's preference or desired exercise. By adjusting the location of stopper 20*c* along end 20*b*, the user can modify the resting height of receiving unit 22 as needed.

After base bar 16 is properly attached to walking frame 28 and while supporting one's self with walking frame 28 in the typical manner, the user can then engage a limb, in this embodiment, a foot, with receiving unit 22. By pushing or pulling receiving unit 22 against resistance member 24, or holding receiving unit 22 in a desired position, the user can perform rehabilitative exercises anywhere without undue difficulty. While this embodiment refers to foot engagement with receiving unit 22 for leg exercises, it is also possible to utilize the device with one's hands or arms for upper body exercises.

When the user moves receiving unit 22 against resistance member 24, by stepping down, cable 20 engages in grooves 18*a* of guide members 18 and causes guide members 18 to rotate toward receiving unit 22 about their substantially horizontal axes. Simultaneously, outside end 20*a* engages in groove 32*a* of upper resistance guide member 32, resulting in upward sliding motion of upper resistance unit 30. Lower band catch 36 is rigidly held in place and thus, the upward sliding motion of upper resistance unit 30 causes stretchable band 38 to stretch. Additionally, the intensity of resistance experienced by the user can be altered by selectively sliding lower band catch 36 toward or further from upper resistance unit 30. Reference numeral 36*b* represents the lower band catch 36 in an alternate position closer to the upper resistance unit 30. Alternatively, stretchable band 38 can be removed and replaced with a band or bands of higher or lower resistance. The rotation of the pulley-like guide members 18 and 32 during use allows the user to experience a smooth exercise and reduces wear on cable support system 20.

While two embodiments have been described, it should be appreciated that various equivalents, alternatives and modifications are possible within the scope of the claimed coverage.

The invention claimed is:

1. An exercise device for facilitating limb movement by the user of a walker having two inverted U-shaped legs, comprising:

a cross bar having a length and first and second ends;

a cable support system operatively associated with said cross bar, including a cable spanning the length of said cross bar, and having first and second ends, the first end of the cable extending from the first end of the crossbar;

a resistance member operatively engaged with the cable support system and positioned proximate said second end of the cable, the resistance member comprising at least one stretchable band disposed on at least one slidable catch panel and at least one selectively stationary catch, said slidable catch panel being longitudinally spaced from said selectively stationary catch;

a stirrup capable of receiving a limb to be exercised attached to said first end of the cable; and a connector having arms for engaging the legs of a walker.

2. The exercise device of claim 1, wherein said connector comprises a base bar that extends transversely to the cross bar from a first end to a second end.

3. The exercise device of claim 2, wherein said connector comprises a connection member disposed between and attachable to both said cross bar and base bar.

4. The device of claim 3, wherein said base bar is engageable with two adjacent legs of said walker.

5. The device of claim 1, wherein said cross bar is selectively rotatable about a vertical axis passing through said connection member.

6. The device of claim 1, wherein the resting height of said stirrup is adjustable.

7. The device of claim 1, wherein the degree of resistance delivered by said resistance member is adjustable.

8. The device of claim 1, wherein said at least one slidable catch panel further comprises a guide member.

9. The device of claim 8, wherein a portion of the cable adjacent the second end of the cable is engaged with said guide member so that when the first end of the cable is pulled said portion of the cable and said at least one slidable catch panel move in a direction away from the resistance member.

10. The device of claim 8, wherein the degree of resistance can be increased or decreased by selectively increasing or decreasing the longitudinal spacing between said at least one slidable catch panel and said at least one selectively stationary catch.

11. The device of claim 1, wherein the degree of resistance can be altered by substituting different stretchable bands.

12. The device of claim 1, comprising a stopper mechanism located on the first end of said cable between said stirrup and said first end of the cross bar.

13. The device of claim 12, wherein the location of said stopper mechanism along said cable is adjustable.

14. The device of claim 1, wherein the cross bar is a U-bar defining a U-shaped channel and the cable support system comprises at least two guide members disposed within said U-shaped channel, whereby said cable is disposed on said guide members and said guide members facilitate lateral movement of the cable.

15. The device of claim 3, wherein the connection member spans at least the length of and surrounds said resistance member on at least three sides.

16. An exercise device for facilitating limb movement by the user of a walker having two inverted U-shaped legs, comprising:

a cross bar having a length and first and second ends;

a cable support system operatively associated with said cross bar, including a cable spanning the length of said cross bar, and having said first end extending from the first end of the crossbar;

a resistance member attached to said second end of the cable;

a stirrup capable of receiving a limb to be exercised attached to said first end of the cable; and a connection unit for rigidly connecting the exercise device to a walker, the connection unit comprising a base bar that extends transversely to the cross bar from a first end to a second end;

a connection member disposed between and attachable to both said cross bar and base bar; and a support unit rigidly attached to said connection member between, the base bar and the cross bar, said support unit defining a bottom surface engagable with one of the inverted U-shaped legs of said walker.

17. The device of claim 16, wherein the resistance member is a weight.

18. The device of claim 16, comprising a stopper mechanism located on the first end of said cable between said stirrup and said first end of the cross bar.

19. The device of claim 16, wherein the connection member spans at least the length of and surrounds said resistance member on at least three sides.

20. The device of claim 16, wherein the degree of resistance is adjustable.

* * * * *